US005268075A

United States Patent [19]

Chang et al.

[11] Patent Number: 5,268,075

[45] Date of Patent: Dec. 7, 1993

[54] HIGH EFFICIENCY TWO-STEP, HIGH-LOW PH CHLORINE DIOXIDE PULP BLEACHING PROCESS

[75] Inventors: Hou-min Chang; Hasan Jameel; Geoffrey E. Seger, all of Raleigh, N.C.

[73] Assignee: North Carolina State University, Raleigh, N.C.

[21] Appl. No.: 649,848

[22] Filed: Feb. 1, 1991

Related U.S. Application Data

[63] Continuation-in-part of Ser. No. 424,347, Oct. 19, 1989, abandoned.

[51] Int. Cl.[5] ..... D21C 9/14

[52] U.S. Cl. ..... 162/89; 162/65

[58] Field of Search ..... 162/88, 89, 87, 66, 162/67, 65

[56] References Cited

U.S. PATENT DOCUMENTS 3,884,752 5/1975 Campbell et al. ..... 162/88

4,274,912 6/1981 Carles et al. ..... 162/41

FOREIGN PATENT DOCUMENTS 1149111 7/1983 Canada ..... 162/88

OTHER PUBLICATIONS

Macas et al, "The Effect of Chlorine in the Di Stage", J of Pulp & Paper Science, vol. 13, No. 3 May 1987, pp. J106–J110.

Publication by Teder et al., "Carbohydrate Degradation in Chlorine Dioxide Bleaching", in Tappi, Dec. 1978, vol. 61, No. 12, pp. 59–62.

*Primary Examiner*—Steve Alvo

*Attorney, Agent, or Firm*—Richard E. Jenkins

[57] ABSTRACT

A high-efficiency wood pulp bleaching process to produce wood pulps with higher brightness at equal chlorine dioxide usage or of equal brightness at significantly reduced chlorine dioxide usage. The process comprises reacting the chlorine dioxide with wood pulp at a pH of about 5–10 for about 5–40 minutes and then acidifying the mixture to a pH of about 1.9–4.2. The mixture is then allowed to react for about 2 or more hours to complete the two-step high/low pH bleaching process.

13 Claims, 13 Drawing Sheets

HIGH EFFICIENCY TWO-STEP, HIGH-LOW PH CHLORINE DIOXIDE PULP BLEACHING PROCESS

RELATED APPLICATION

This application is a continuation-in-part of application Ser. No. 424,347, filed Oct. 19, 1989, and now abandoned.

TECHNICAL FIELD

The present invention relates to the bleaching of pulp and more particularly to an improved process for bleaching wood pulp with chlorine dioxide in a manner whereby the wood pulp is subjected to a 2-step high pH/low pH bleaching stage which results in a substantial decrease in the usage of chlorine dioxide required to brighten wood pulp.

BACKGROUND ART

As is well known in the wood pulp bleaching art, the main objectives of wood pulp bleaching are to increase the brightness of the pulp and to make it suitable for the manufacture of printing and tissue grade papers by removal or modification of some of the constituents of the unbleached pulp, including the lignin and its degradation products, resins, metal ions, non-cellulosic carbohydrate components, and various types of flecks. The bleaching of chemical wood pulp is normally carried out in multiple processing stages utilizing elemental chlorine, caustic soda, hypochlorites, oxygen, hydrogen peroxide, and chlorine dioxide. The number of stages required in a particular bleaching process is dependant upon the nature of the unbleached pulp as well as the end use to which the pulp will be put. A sulfate or kraft pulp is today most typically bleached in a five stage sequence which is designated as (CD)(EO)DED. In the (CD)(EO)DED designation, D denotes chlorine dioxide, C denotes elemental chlorine, E denotes caustic extraction, and O denotes oxygen gas. The multi-stage process in essence comprises a chlorination step (CD), a first oxidative extraction stage (EO), a first bleaching stage ($D_1$), a second caustic extraction stage ($E_2$), and a second and final bleaching stage ($D_2$).

In the conventional (CD)(EO)DED multi-stage bleaching process, each of the two chlorine dioxide bleaching stages is carried out in a one-step process at an end pH of about 3.8 for three hours at 70° centigrade. It is commonly known that pH has an important bearing on brightness and strength properties as well as the chemical species present in the wood pulp mixture, and this particular pH has heretofore been considered optimal for each of the two chlorine dioxide bleaching stages in the (CD)(EO)DED sequence. It should also be appreciated that although the (CD)(EO)DED sequence has been specifically addressed, the one-step chlorine dioxide bleaching stage can be used in any D stage for most other three, four, five, or six-stage bleaching processes known to those familiar with the art of wood pulp bleaching.

A shortcoming of the one-step chlorine dioxide bleaching stage presently used in the pulp and paper industry is that approximately 30% of the chlorine dioxide is lost to the formation of the unreactive species chlorite and chlorate, and this is very undesirable in view of the relatively high cost of chlorine dioxide. The present invention solves this well-known deficiency in state of the art chlorine dioxide bleaching by significantly reducing the chlorine dioxide loss during the chlorine dioxide bleaching process. The advantages of the reduced loss of chlorine dioxide are a very significant reduction in the cost of the wood pulp bleaching process as well as the reduction of pollution levels.

DISCLOSURE OF THE INVENTION

In accordance with the present invention, applicant provides an improved process for bleaching wood pulp in an aqueous suspension using chlorine dioxide which substitutes a two-step bleaching stage for the conventional one-step bleaching stage known to those familiar with the wood pulp bleaching art. The novel process comprises first subjecting the aqueous wood pulp suspension to a first bleaching step by mixing it with an aqueous solution of chlorine dioxide and maintaining the mixture at a pH between about 5–10 for about 5–40 minutes. Next, an acid or acid gas is introduced into the mixture in order to bring the pH down to a pH between about 1.9–4.2, and the mixture is then subjected to a second bleaching step at the reduced pH for 2 or more hours, most suitably between about 2.5–3.9 hours. This novel process can be used in the $D_1$ or $D_2$ stage of the (CD)(EO)DED bleaching sequence as well as in any D bleaching stage of other three, four, five, six, and seven-stage bleaching sequences. The operating temperature during the novel process should be between about 55°–85° C., and the pulp's final consistency should be between about 3–12%.

It is therefore an object of the present invention to provide more efficient chlorine dioxide bleaching in the wood pulp bleaching process.

It is another object of the present invention to significantly reduce the conversion of chlorine dioxide to non-bleaching chemicals during the wood pulp bleaching process.

It is still another object of the present invention to reduce the cost of the wood pulp bleaching process.

It is yet another object of the present invention to achieve a higher wood pulp brightness with a selected chlorine dioxide charge than has heretofore been possible.

BRIEF DESCRIPTION OF THE DRAWINGS

Some of the objects having been stated, other objects will become evident as the description proceeds, when taken in connection with the accompanying drawings, in which.

BEST MODE FOR CARRYING OUT THE INVENTION

Figure 1:
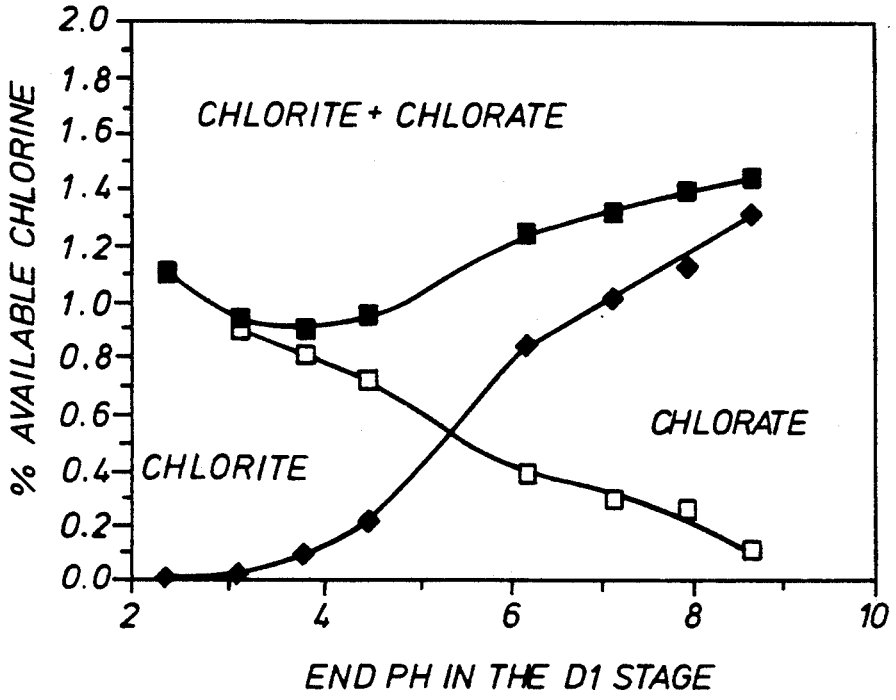
FIG. 1 is a graph of the effect of pH on chlorate and chlorite formation in chlorine dioxide bleaching of kraft pulp (reprinted from "The Bleaching of Pulp", Ed. R. P. Singh, p. 137)

Chlorine dioxide bleaching of kraft pulps is typically carried out at an end pH of 3.8 for 3 hours at 70° centigrade. It is commonly known that pH has an important bearing on brightness and strength properties as well as the chemical species present in the mixture. As shown in FIG. 1 of the drawings, the formation of chlorate increases as the pH of the solution is decreased. Below pH 5 a major loss of oxidizing power occurs since the chlorate formed is inactive as a bleaching agent. Conversely, as the pH is increased, the conversion of chlorine dioxide to the chlorite anion is increased which is also inactive toward lignin. The sum of chlorite plus chlorate is lowest at end pH 3.8 which is found to be optimal for chlorine dioxide bleaching. However, formation of chlorite is not actually lost oxidizing capability since acidifying the chlorite solution forms chlorous acid which is known to be very reactive toward lignin.

In order to increase the efficiency of chlorine dioxide bleaching, a new two-step process has been discovered. The process is as follows:

1. Pulp is mixed with sodium hydroxide and subsequently mixed with chlorine dioxide in a conventional manner. The pH is maintained between about 6 and 7.5 for optimum brightness and viscosity although beneficial results are also found in a pH range of about 5–10. Reaction time is varied between about 5–40 minutes, and the reaction temperature is between about 55°–85° centigrade, most suitably about 70° centigrade.

2. After the initial bleaching step, the pulp mixture is acidified to an optimum end pH of 3.8 with sulfuric acid, hydrochloric acid, or other suitable acid. Although a pH of 3.8 is optimal for brightness, end pH values of 1.9–4.2 have been recorded with substantial brightness gains over conventional bleaching methods. Final consistency of the pulp is between about 3–12%, most suitably about 10%, and reaction time in this second step is 2 or more hours, most suitably between about 2.5 and 3.9 hours. Reaction temperature is between about 55°–85° centigrade, and most suitably about 70° centigrade.

To prove the efficacy of the new process generally described above, detailed bleaching experiments were carried out by applicant on southern pine kraft pulp. The furnish was obtained from the decker before the bleach plant, and to insure maximum mixing CD stage bleaching was done in plastic Nalgene bottles which rolled on a ball-mill type apparatus for the full reaction time. All other bleaching stages were carried out in sealed polyester bags which were kneaded at various times throughout the bleach to insure proper mixing.

Processing parameters used by applicants for the multiple bleaching stages are listed in Table 1 below. Chlorination stage charges were varied to achieve target (CD)E kappa numbers, and all charges are on OD brownstock pulp. Optimum high/low pH values are 6–7.5 and 3.8, respectively. Large batches of (CD)E pulp were made and then divided into individual DED runs for comparison. All comparisons were made on pulps from the same (CD)E batch, and all water used in bleaching and washing was distilled. Chlorine dioxide solutions used in testing were generated on site by acidifying sodium chlorite solution and absorbing the $ClO_2$ gas in cold distilled water. Chlorine content in the solutions was kept between 7 and 10% (active basis).

Processing parameters for the bleaching experiments and the analytical methods used in the experiments are as follows:

TABLE 1

| Stage | Charge | Time | Temperature | Consistency | End pH |
|---|---|---|---|---|---|
| CD | .17-.22 × Kappa % Available Chlorine on Pulp (10% $ClO_2$ Substitution) | 1 hour | 30-40° C. | 3% | <1.8 |
| $E_1$ | 0.7 × $Cl_2$ % of Caustic on Pulp | 1 hour | 70° C. | 10% | >11.5 |
| $D_1$ | varied | 3 hours | 70° C. | 10% | 3-4 |
| H/L $D_1$ | varied | 5-15 mins. | 70° C. | 10.5-13% | 5-10 |
| | | 2.75-2.9 hrs. | 70° C. | 10% | 1-9-4.2 |
| $E_2$ | 0.75% | 1 hour | 70° C. | 10% | >11.5 |
| $D_2$ | varied | 3 hours | 70° C. | 10% | 3.5-3.8 |

BRIGHTNESS Elrepho 2000 ISO
VISCOSITY TAPPI T230 os-76
KAPPA NUMBER TAPPI T236 hm-85
TOCl (AOX) EPA method 9020
CHLORATE Ion Chromatography

Brightness

Figure 2:
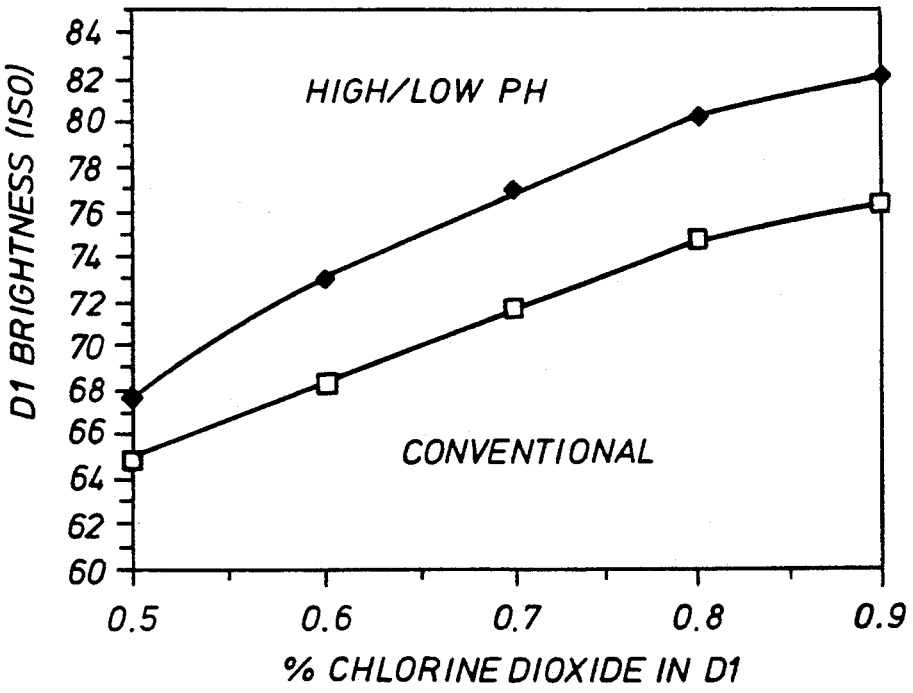
FIG. 2 is a graph of $D_1$ brightness for the pulp of FIG. 2 when the $D_1$ charge is varied on the pulp for the conventional one-step bleaching process and the novel two-step bleaching process of the present invention.
Figure 3:
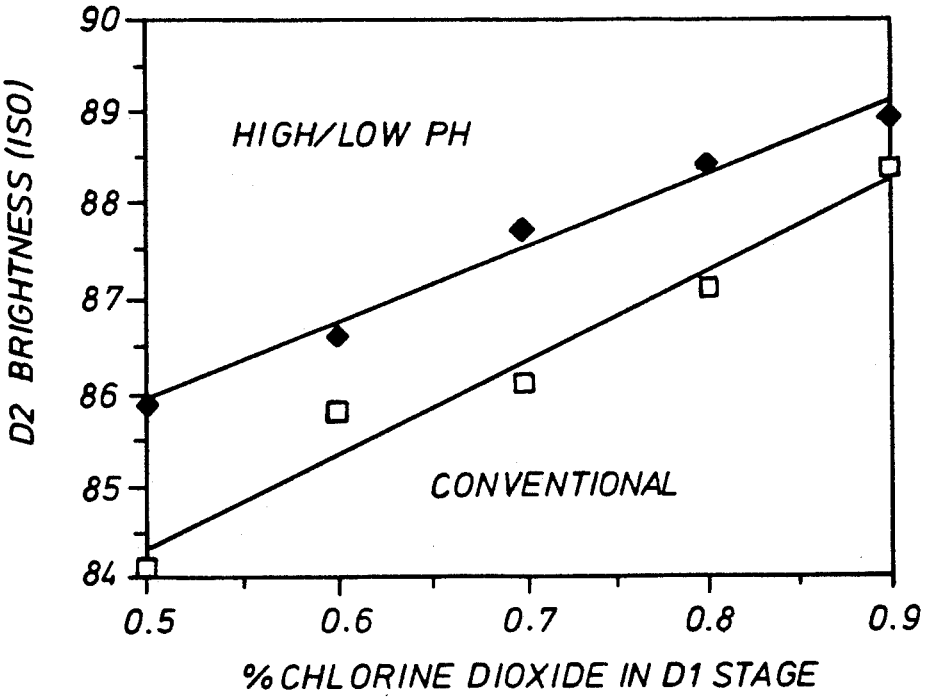
FIG. 3 is a graph of $D_2$ brightness versus chlorine dioxide charge for the conventional one-step bleaching process and the novel two-step bleaching process of the present invention wherein the $D_2$ charge is 0.2% $ClO_2$ on pulp.

On the basis of the results achieved in the bleaching tests, a substantial increase in brightness is always found using the high/low pH bleaching method as compared to conventional bleaching methods. As seen in FIG. 2, the $D_1$ brightnesses achieved were higher than those of the present $ClO_2$ bleaching techniques. In FIG. 2, high pH values are between 8 and 9.5, and low pH values are from 1.9-2.1. The control had end pH values of 3.3 to 3.7. At a brightness level of 76 ISO, a charge of 0.9% $ClO_2$ on OD pulp was needed for conventional bleaching while only 0.68% was needed using the high/low bleaching method. This accounts for a 24% savings in chlorine dioxide. In 5-stage (CD)(EO)DED bleaching, however, the effect of the brightness gain is reduced in the final bleaching stage ($D_2$). This is shown in FIG. 3, where the pulps of FIG. 2 are further bleached in the $E_2$ and $D_2$ stages wherein the $D_2$ stages are run conventionally. After the final bleaching stage, a 15% savings in chlorine dioxide is realized at a brightness of 88.3 ISO.

Figure 4:
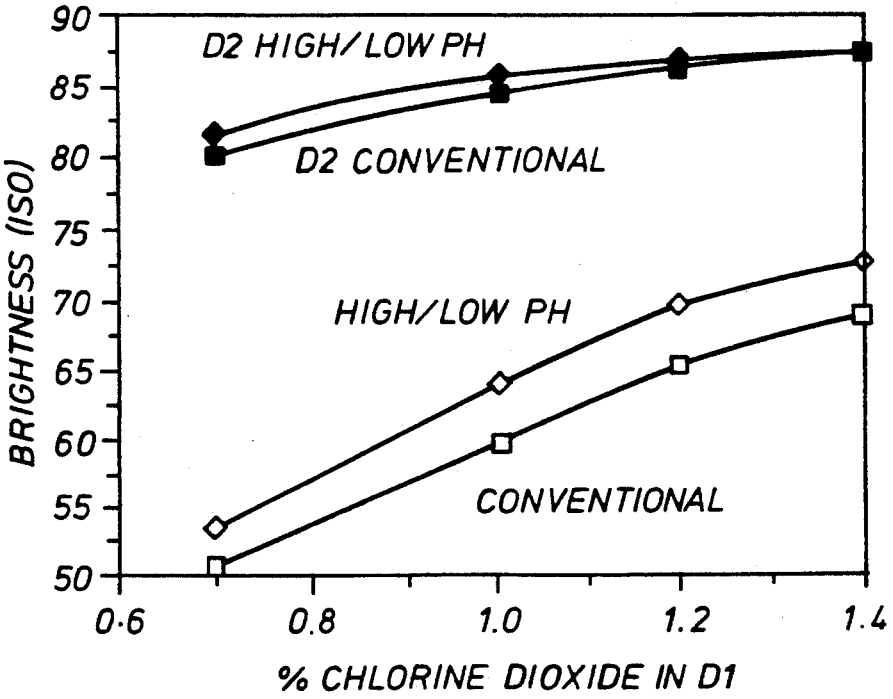
FIG. 4 is a graph of $D_1$ and $D_2$ brightness versus chlorine dioxide charge for the conventional one-step bleaching process and the novel two-step bleaching process of the present invention.

Regardless of the incoming (CD)E kappa number (lignin concentration), chlorine dioxide savings are always found using the high/low pH bleaching process. This is illustrated in FIG. 4 for pulp with a (CD)E kappa number of 8.5. Again a savings of approximately 0.2% $ClO_2$ on pulp is realized in the $D_1$ stage, and the magnitude of savings is lower at a comparable $D_2$ brightness. Thus, even at high (CD)E kappa values, substantial reductions in chlorine dioxide use are realized by the bleaching method of the invention.

Similar brightness ceilings are reached in the $D_1$ stage irrespective of which method of bleaching is used. This occurs around 84.0 ISO for both methods for an incoming (CD)E kappa of 4.4 (see FIG. 5). In FIG. 6, $D_2$ pulp from FIG. 5 was found to have an 11% savings in chlorine dioxide even at a very high brightness of 90.5 ISO, but eventually the ceiling is reached at 91.4 ISO at a total charge of 1.2% $ClO_2$ on OD pulp.

One of the major applications of the novel high/low pH bleaching process is in a three stage sequence (see FIG. 6(*a*)). Current trends toward reducing operational and capital costs of pulp mills have led to the development of short sequence technologies in the pulp and paper industry. The major three-stage sequences are (CD)(EO)D and (CD)(EOP)D, and with high/low pH bleaching it is possible to decrease chlorine dioxide usage by as much as 29% in these processes.

Pulp Viscosity

Figure 7:
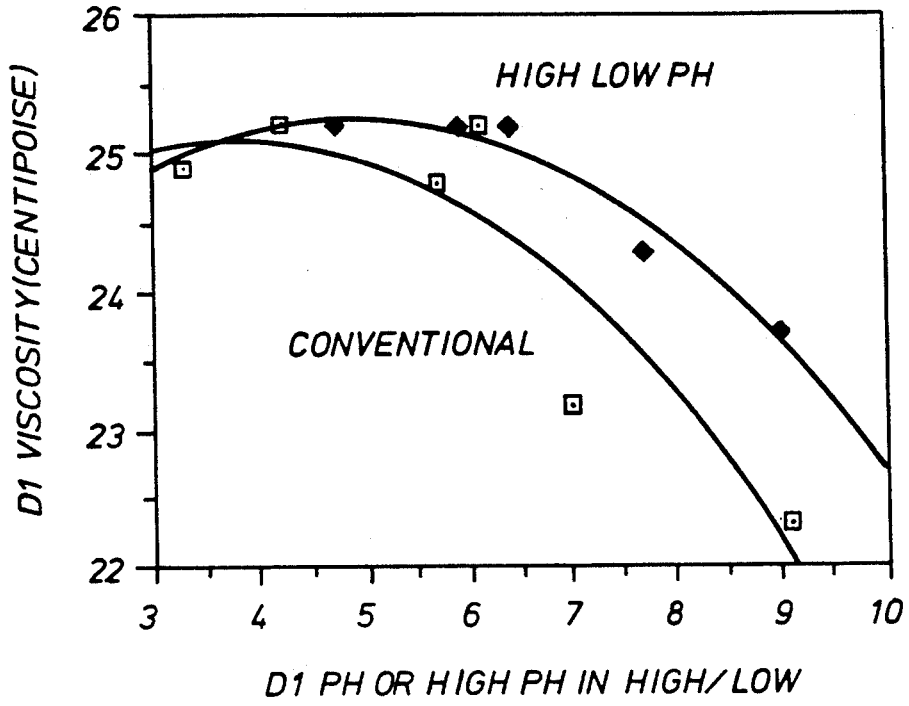
FIG. 7 is a graph of $D_1$ viscosity versus $D_1$ pH for the conventional one-step bleaching process and high pH for the novel two-step bleaching process of the present invention.

Pulp viscosity measurements were made using TAPPI standard T 230 os-76. Earlier experimental work has indicated that chlorine dioxide at a pH of less than 5 reacts selectively with lignin, and at a pH greater than 7 chlorine dioxide reacts with the carbohydrate and lignin in the pulp vigorously, which in turn degrades the cellulose chain. As shown in FIG. 7, pulp viscosity depends heavily on the pH of the reacting mixture. Pulp viscosity decreases slowly from pH 6 to 7, then falls rapidly at pH values higher than 7. The decrease in viscosity at the high pH for the two-step high/low pH bleaching process is not significant because of the low reaction time in the high pH step. From viscosity and brightness data obtained, a pH of 6-7.5 and a pH of 3.8 is optimal for the high pH and low pH, respectively, in the two-step high/low pH bleaching process.

Table 2 below gives an example of pulp qualities measured from a bleach run performed on a pulp of (CD)E kappa=4.4 and viscosity 25 cp. An average viscosity drop of 0.6 centipoise was detected for the two-step high/low pH bleaching process as compared to conventional bleaching results. Other bleach runs performed showed a similar effect.

TABLE 2

| CONVENTIONAL BLEACHING | | | | |
|---|---|---|---|---|
| Charge | End pH | CED Bright ISO | (CD) EDED Bright ISO | Viscosity CP |
| 0.4% | 3.6 | 60.2 | 86.0 | 24.8 |
| 0.6% | 3.4 | 70.5 | 89.2 | 24.7 |
| 0.8% | 3.4 | 78.3 | 90.4 | 24.7 |
| 1.0% | 3.5 | 84.6 | 91.4 | 24.5 |

| HIGH/LOW pH BLEACHING | | | | | |
|---|---|---|---|---|---|
| Charge | High pH | Low pH | CED Bright ISO | (CD) EDED Bright ISO | Viscosity CP |
| 0.4% | 7.2 | 3.8 | 67.5 | 87.6 | 24.5 |
| 0.6% | 7.1 | 3.7 | 78.5 | 89.9 | 24.1 |
| 0.8% | 6.7 | 3.2 | 82.2 | 90.9 | 24.0 |
| 1.0% | 7.0 | 3.0 | 84.5 | 91.4 | 24.1 |

Total Organic Chlorine (TOCl) or (AOX)

Figure 8:
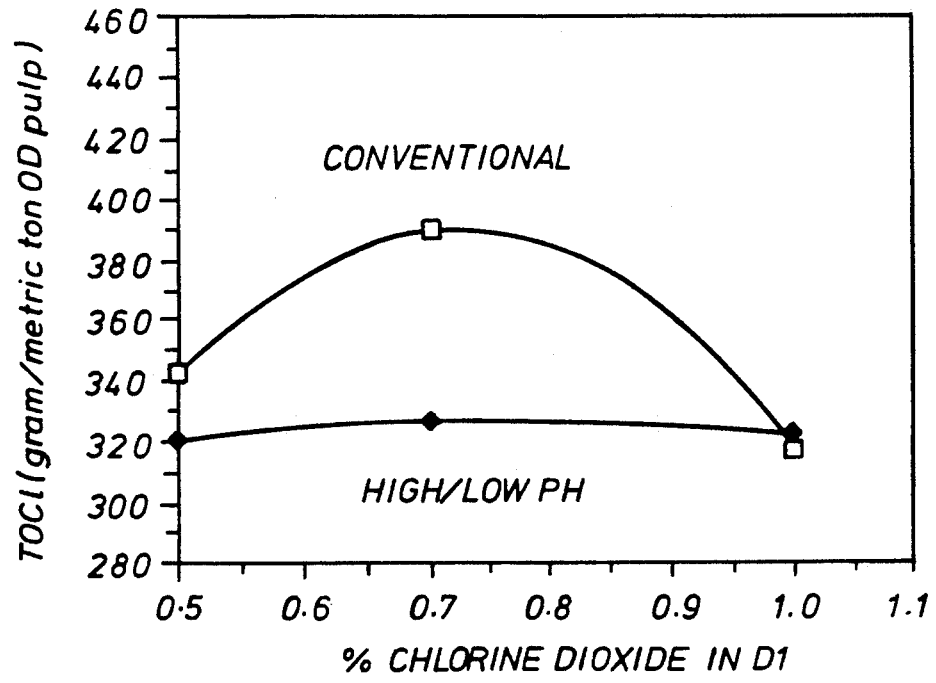
FIG. 8 is a graph of total organic chlorine (TOCl) or (AOX) in $D_1$ plus $E_2$ effluents versus chlorine dioxide charge in $D_1$ for the conventional one-step bleaching process and the novel two-step bleaching process of the present invention.

TOCl (AOX) measurements in applicant's tests were made on both the $D_1$ and $E_2$ for one data set. The values were added together and are shown in FIG. 8 of the drawings. Surprisingly, conventional bleaching TOCl values were parabolic versus an increasing $ClO_2$ charge while TOCl values with the high/low pH bleaching method varied only slightly. A greater decrease in TOCl from bleaching with the two-step high/low pH bleaching process can be realized by substituting the chlorine dioxide saved in the $D_1$ stage back into the chlorination stage (CD) of the multi-stage bleach sequence. This would result in a decrease in TOCl (AOX) in effluents from the bleach plant.

Chlorate

Chlorate ($ClO_3^-$) is a well known herbicide, and discharge of chlorate from paper mills has been gaining more attention from environmentalists now that possible detrimental effects on various microalgaes have been observed. Thus, improving the efficiency of chlorine dioxide bleaching by lowering chlorate production may have a favorable impact on both economic and environmental issues. Conversion of chlorine dioxide to chlorate can be lowered by the two-stage high/low pH bleaching method for most chemical charges on pulp. At very high chemical charges (or lower lignin concentrations), chlorate formation is independent of whether the new or conventional bleaching method is used, because a brightness ceiling is reached.

Thus, it is important to determine if the chlorine dioxide saved using the two-step high/low pH bleaching process is due to a subsequent decrease in the formation of chlorate. The two possible pathways of forming chlorate are set forth in Equations 1 and 2 below:

$$2ClO_2+2OH^-\rightarrow ClO_3^-+ClO_2^-+H_2O \quad \text{Equation 1}$$

$$2HClO_2\rightarrow H^++HClO+ClO_3^- \quad \text{Equation 2}$$

Figure 9:
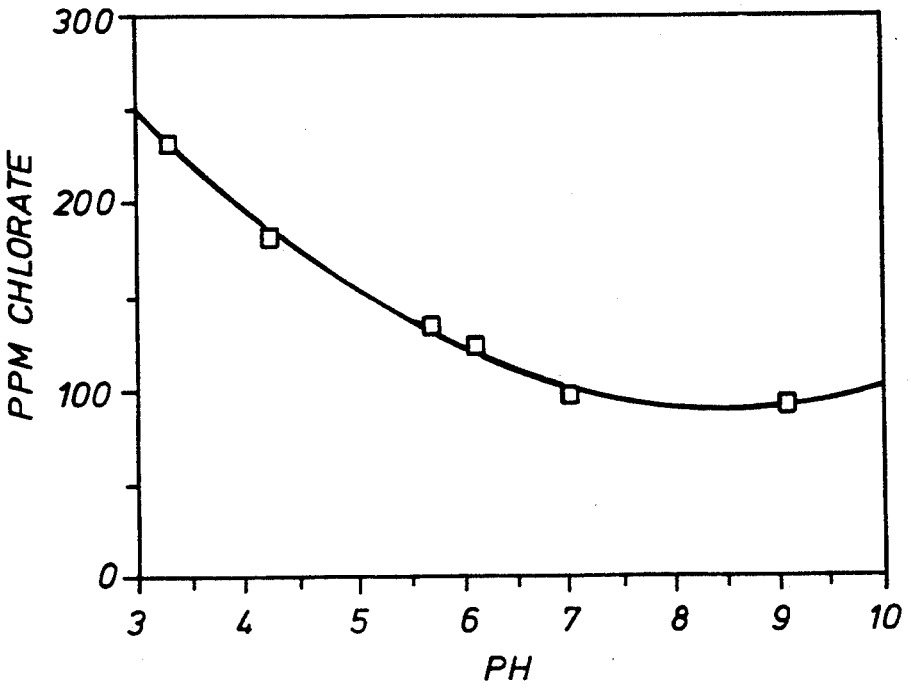
FIG. 9 is a graph of chlorate formed in the $D_1$ stage versus end pH.

Equation 1 is not a very prominent reaction in bleaching carried out at pH 7 since only a small concentration of hydroxyl ions are present. Under typical bleaching conditions, the pH starts around 5 and drops to less than 4 by the end of the bleaching process. At pH 5, less than 1% hydroxyl ions would be present for reaction, and at pH 4 only 0.1% exist. Supporting evidence for this observation is shown in FIG. 9 of the drawings. The trend indicated shows that as the pH is increased up to 9, the formation of chlorate decreases.

The major pathway for chlorate formation is Equation 2 above. In principle, chlorous acid reacts with itself to form chlorate and hypochlorous acid. This is a biomolecular reaction which is considered to be slow at low concentrations. Chlorous acid, as stated above, is very reactive toward lignin. Chlorous acid oxidizes lignin and is reduced to hypochlorous acid according to Equation 3:

$$HClO_2+\text{LIGNIN}\rightarrow HClO+\text{OXIDIZED LIGNIN} \quad \text{Equation 3}$$

Figure 10:
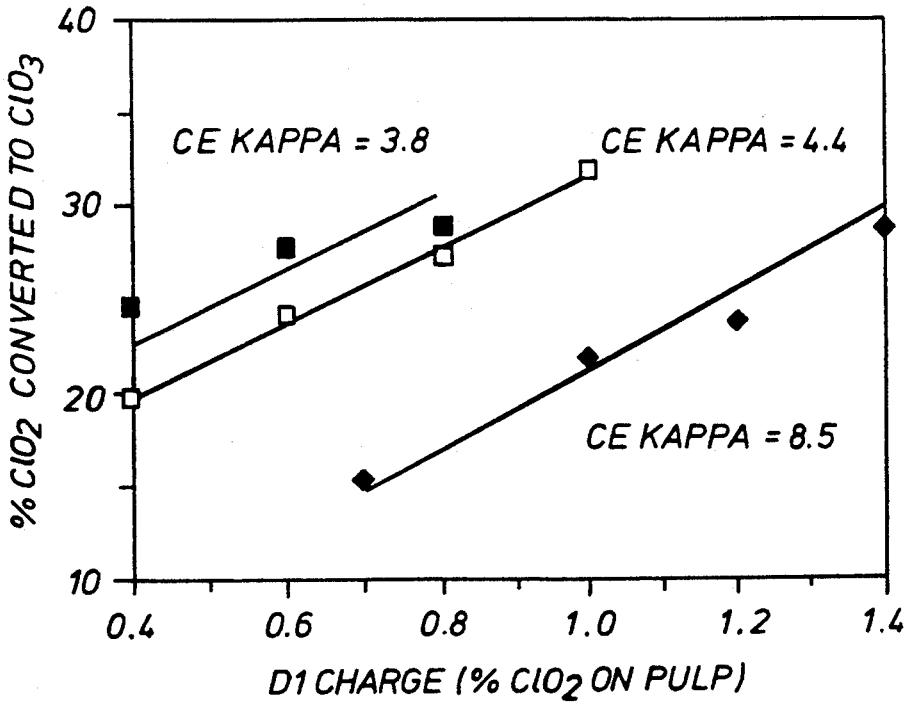
FIG. 10 is a graph of chlorate formed versus $D_1$ charge and CE kappa number for conventional bleaching.
Figure 11:
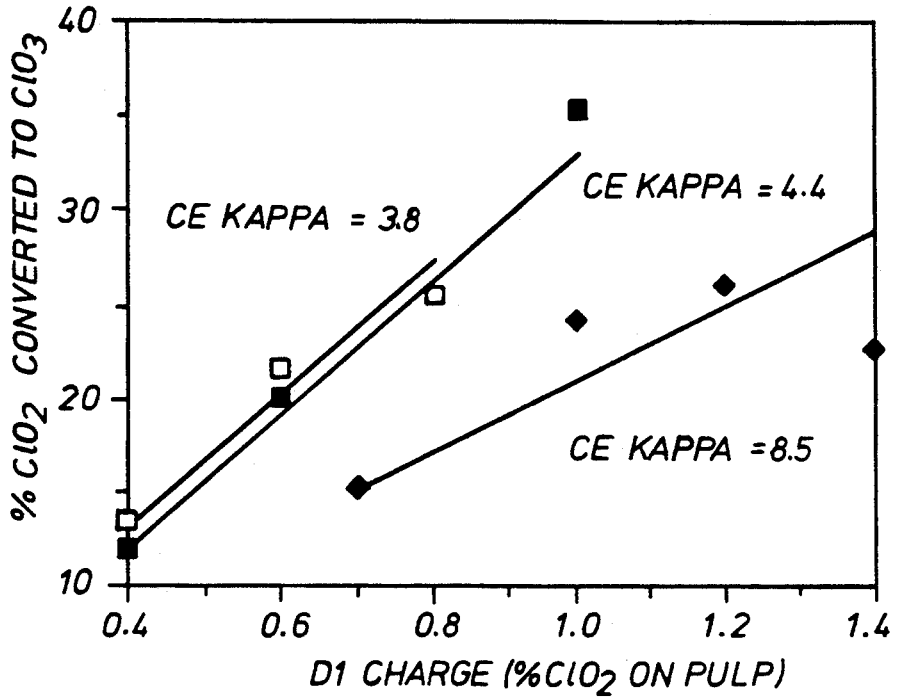
FIG. 11 is a graph of chlorate formed versus $D_1$ charge and CE kappa number for the novel two-step high/low pH bleaching process of the present invention.

During chlorine dioxide bleaching, a competitive pathway is present for consumption of chlorous acid. A high chemical charge would increase the rate of reaction of Equation 2, and a high lignin concentration would increase the rate of reaction of Equation 3. FIG. 10 shows a plot of $D_1$ charge of chlorine dioxide versus % chlorine dioxide converted to chlorate for conventional chlorine dioxide bleaching. As the lignin concentration is increased (low chemical charge or higher kappa number) less chlorate is formed. Likewise if a high concentration of chemical is present (low kappa number), the higher the formation of chlorate. The same trend also holds true for the two-step high/low pH bleaching process as can be seen in FIG. 11. From FIGS. 10 and 11, it is evident that the two-step high/low pH bleaching process significantly lowers chlorate formation at most chemical charges. However, little difference is seen at high charges where the brightness ceiling is reached.

Figure 5:
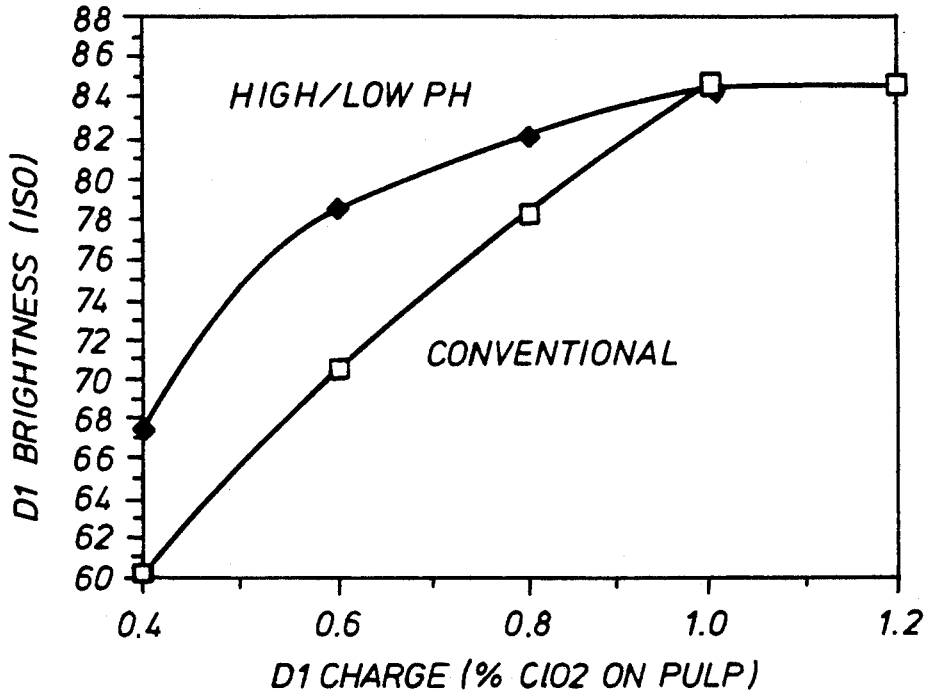
FIG. 5 is a graph of $D_1$ brightness versus percentage (%) chlorine dioxide on the pulp ($D_1$ charge) for the conventional one-step bleaching process and the novel two-step bleaching process of the present invention.
Figure 6:
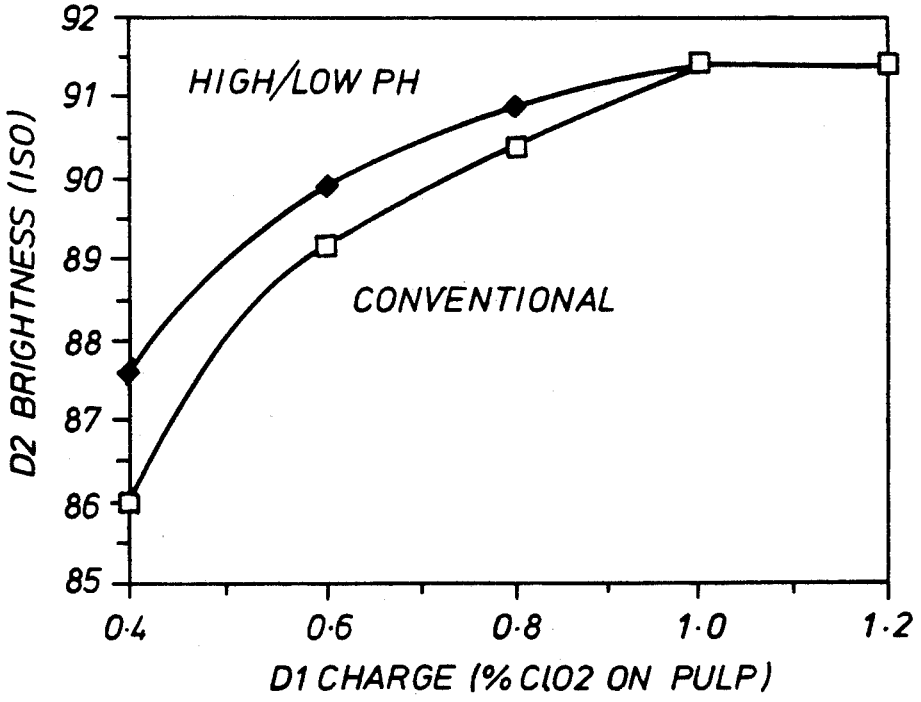
FIG. 6 is a graph of $D_2$ brightness for the pulp of FIG. 5 when the $D_2$ charge is 0.2% chlorine dioxide on the pulp for the conventional one-step bleaching process and the novel two-step bleaching process of the present invention.
Figure 6A:
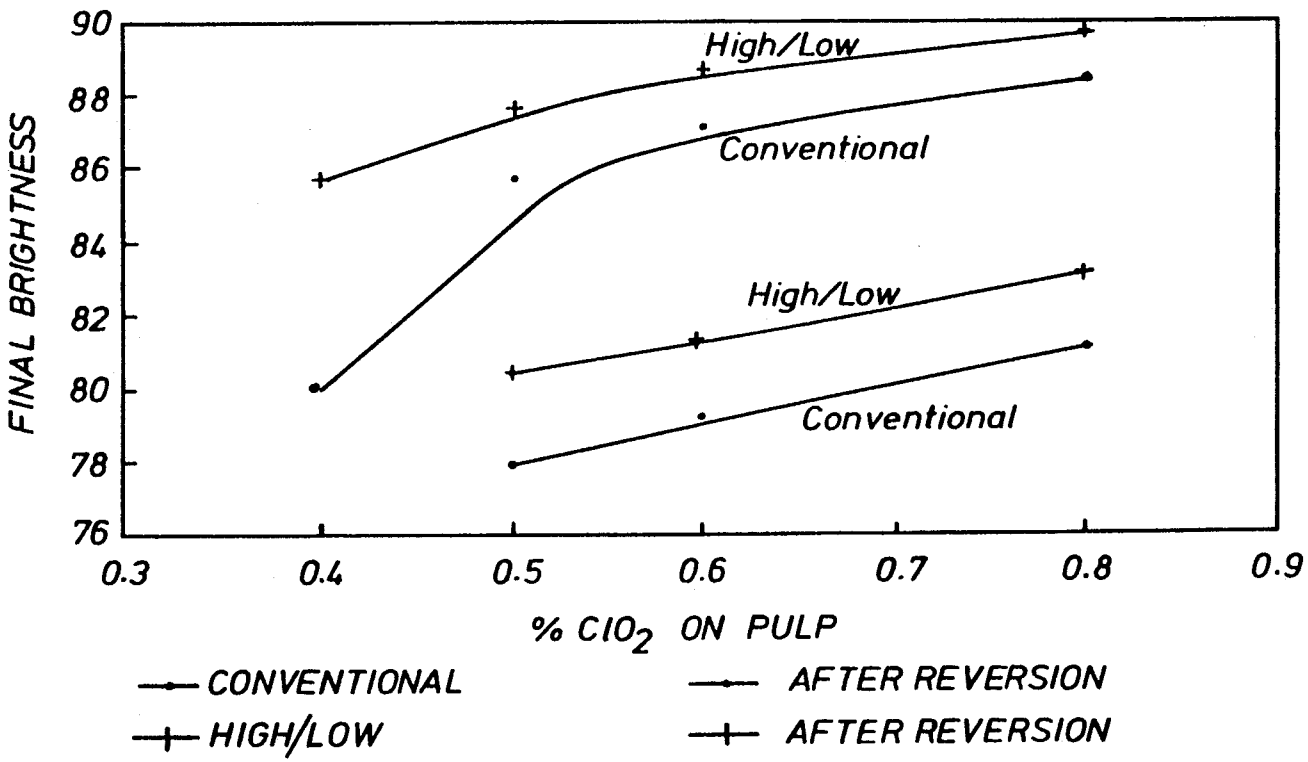
FIG. 6(a) is a graph of final brightness versus $ClO_2$ charge for the conventional one-step process and the novel two-step bleaching process of the present invention using a (CD)(EO)D sequence. Reverted brightness is also shown after 24 hours at 105° C.
Figure 12:
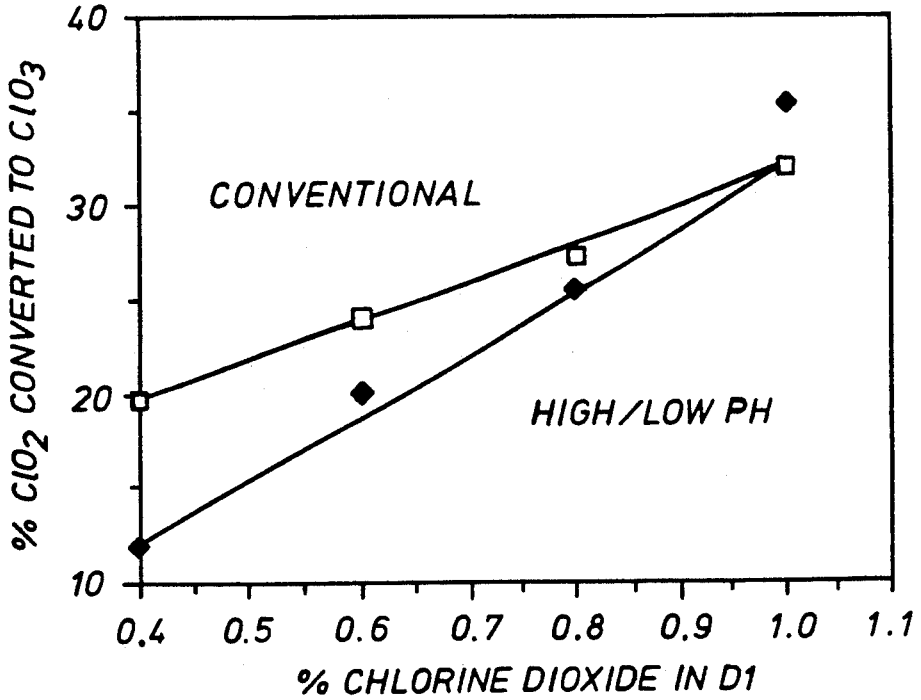
FIG. 12 is a graph of chlorate formed as a percentage (%) of chlorine dioxide converted to chlorate versus percent (%) chlorine dioxide in $D_1$ for the conventional one-step bleaching process and the novel two-step high/low bleaching process of the present invention.
Figure 13:
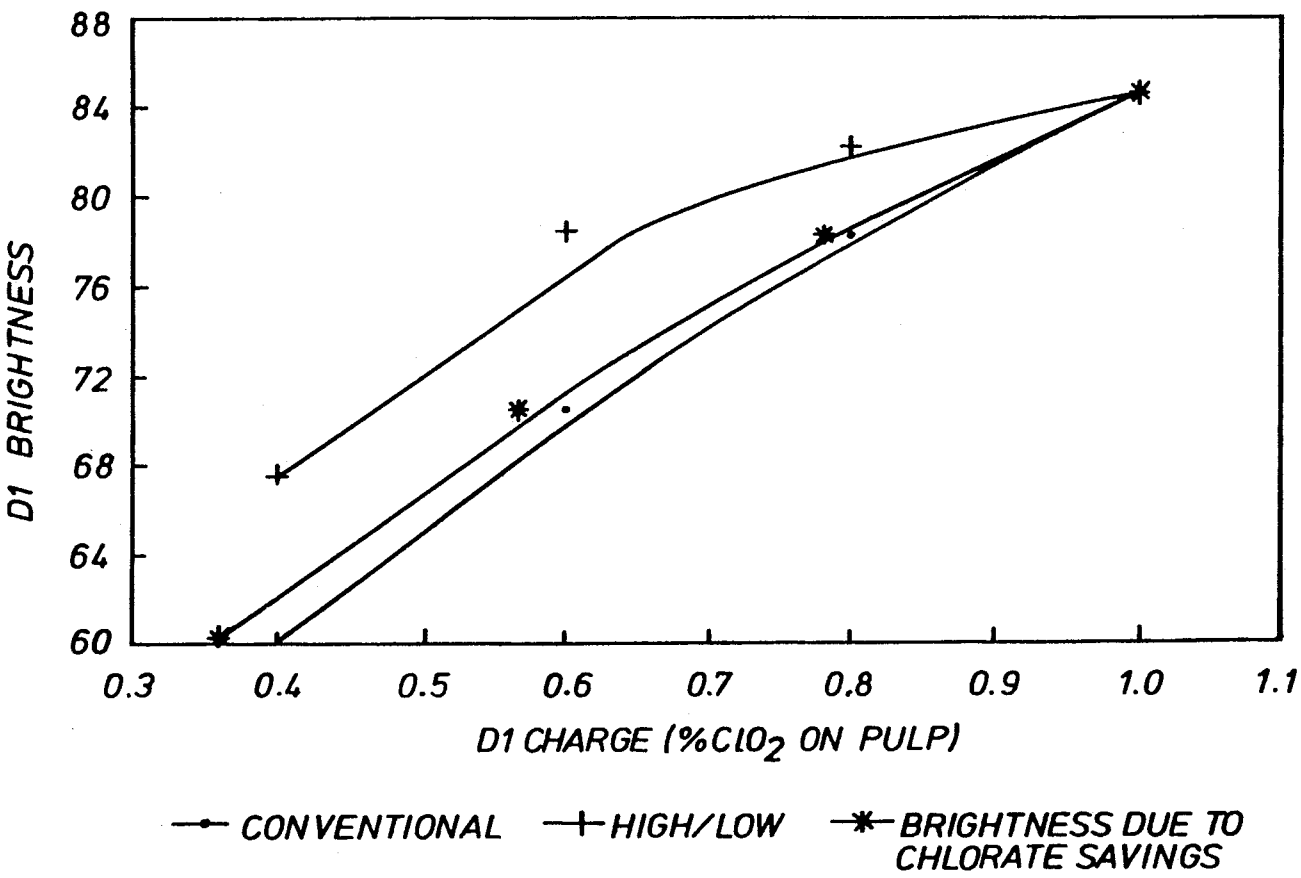
FIG. 13 is a graph of $D_1$ pulp brightness versus the percentage of chlorine dioxide on the pulp ($D_1$ charge) for the conventional one-step bleaching process and the novel two-step high/low pH bleaching process of the present invention (wherein the middle line is the calculated brightness due to reduced chlorate formation)

Corresponding chlorate measurements for the brightness shown in FIG. 5 are plotted on FIG. 12. Again, as the charge is increased, the formation of chlorate rises. In order to determine the chlorine dioxide savings in terms of chlorate reduction, the chlorate measurements are expressed as available chlorine. At a brightness of 78.3 ISO, the high/low pH bleaching process and conventional bleaching required 0.6% and 0.8% $ClO_2$ on pulp, respectively. These charges correspond to 1753 parts per million (ppm) and 2338 ppm, respectively, as available chlorine. The difference provides a savings of 585 ppm available chlorine. Chlorate measurements were found to be 351 ppm and 423.3 ppm as available chlorine for the high/low pH bleaching process and normal bleaching, respectively, at a charge of 0.6% on pulp for a 17% reduction. Subtraction yields a savings of 72.3 ppm available chlorine, which corresponds to only 17% of the total savings realized of 423.3 ppm. FIG. 13 of the drawings demonstrates this effect by replotting FIG. 6 with the calculated savings due to chlorate reduction. It is apparent that a decrease of chlorate is not sufficient to explain the total $ClO_2$ savings. A change in lignin structure and/or greater solubilization of the lignin may be possible explanations for the total savings in the $ClO_2$ observed in the tests.

Figure 14:
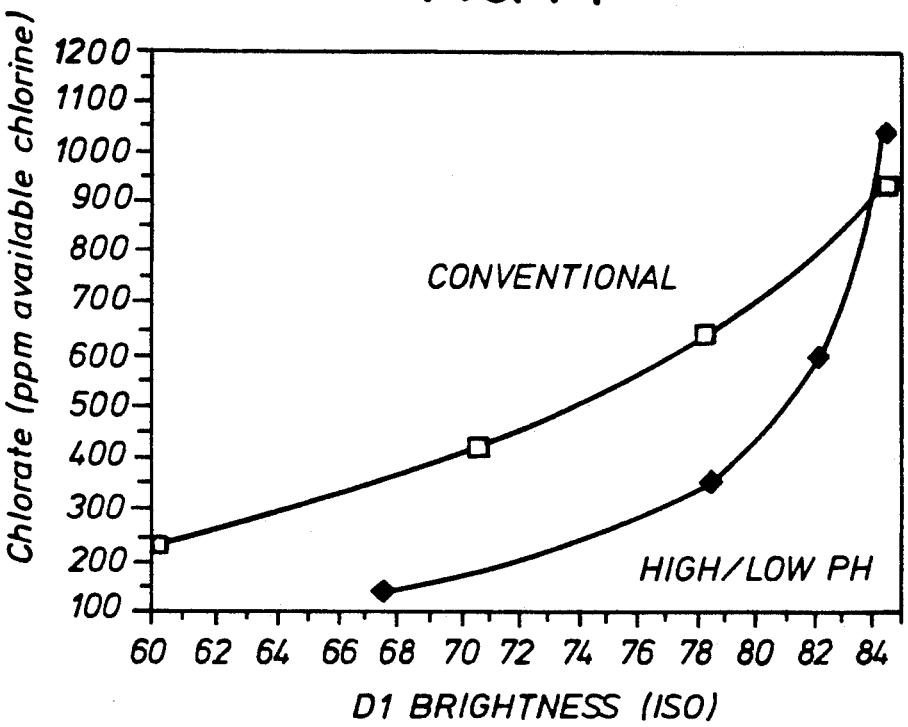
FIG. 14 is a graph of chlorate formation versus $D_1$ brightness for the conventional one-step bleaching process and the novel two-step high/low pH bleaching process of the present invention.

A larger reduction in chlorate is realized at a comparable $D_1$ brightness. As shown in FIG. 14, it is possible to reduce chlorate by as much as 45% (at 78.3 ISO) using the two-step high/low pH bleaching process as compared to a conventional $ClO_2$ bleaching stage. Chlorate formation in the $D_2$ stage is identical for either bleaching process since they are carried out identically.

Process Apparatus

Figure 15A:
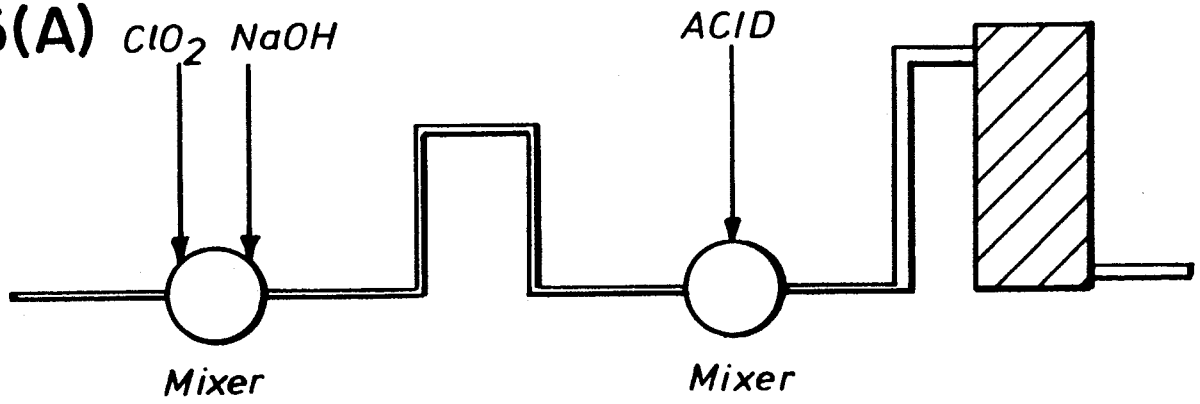
FIG. 15 (*a–b*) is a schematic representation of two (2) different process systems for a wood pulp bleaching plant for incorporating the two-step high/low pH bleaching process of the present invention.
Figure 15B:
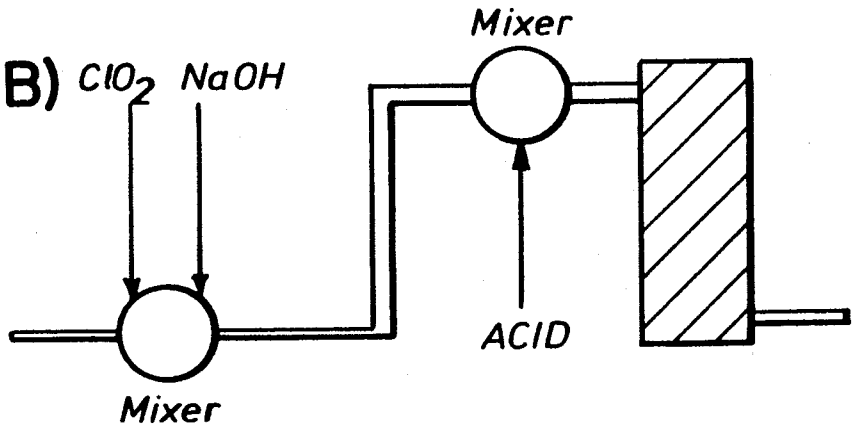

The two-step high/low pH bleaching process can be implemented in both a new plant or an existing pulp bleaching plant. The optimum design schematic is shown in FIG. 15, where $ClO_2$ and caustic are added to the first mixer. The pulp flows into a J or U tube (FIG. 15A) or upflow tower (FIG. 15B) with a retention time of approximately 5–40 minutes. A second mixer is provided to mix the acid for pH adjustment of the wood pulp. The pulp can then be discharged directly to a downflow tower. The retention time in the downflow tower is 2 or more hours and most suitably between about 2.5–3.9 hours. In an existing bleach plant the simplest method for implementing the two-step high/low pH bleaching process technology would be to install a mixer on the discharge from the upflow leg of the tower to the downflow leg of the tower.

Typical chemical charges for conventional bleaching process and high/low pH bleaching process stages are listed in Table 3 below. The chlorine dioxide savings is 4 lb/ton, while the caustic and the acid charge increase by 3 lb/ton and 3.6 lb/ton, respectively.

TABLE 3

| | Conventional Bleaching | High/Low pH Bleaching |
|---|---|---|
| Chlorination | | |

TABLE 3-continued

| | Conventional Bleaching | High/Low pH Bleaching |
|---|---|---|
| % Chlorine | 4.10 | 4.10 |
| % $ClO_2$ | .46 | .46 |
| Extraction | | |
| % Caustic | 3.4 | 3.4 |
| CE kappa | 4.4 | 4.4 |
| Chlorine Dioxide | | |
| % ClO | 0.8 | 0.6 |
| % NaOH | 0.55 | 0.7 |
| % $H_2SO_4$ | | 0.18 |
| Brightness (ISO) | 78.3 | 78.5 |

The following conclusions can be drawn about the novel 2-step high/low pH bleaching process described herein from the bleaching of mill southern pine kraft pulps:

1. The high/low pH bleaching process reduces chlorine dioxide usage by as much as 24% in the $D_1$ stage;
2. The formation of chlorinated organic material characterized by TOCl can be decreased by the use of the high/low pH bleaching process if the $ClO_2$ saved is substituted into the CD stage;
3. The formation of chlorate is decreased by as much as 45% in the $D_1$ stage using the high/low pH bleaching process at a target $D_1$ brightness;
4. The high/low pH bleaching process can be easily implemented in either a new mill or an existing mill; and
5. The formation of chlorate at acidic bleaching conditions is due to the biomolecular reaction of chlorous acid with itself. Formation of chlorate can be reduced by lower bleach chemical charges or higher kappa number pulps.

Split Charge Two-Step High/Low pH Bleaching

It has also been found that the high/low pH bleaching process can be accomplished (1) without any or with only a slightly increased use of caustic over a conventional one step method and (2) without any acid addition or with only a small addition relative to that required in the high/low bleaching process described hereinbefore. This process involved splitting the charge of $ClO_2$ between the high and low pH steps. Optimum brightness and viscosity are found if 50% or less of the $ClO_2$ used in the stage is charged in the first step. Reaction times and temperatures and pH levels are operated comparably to the two-step high/low pH bleaching process described above. Data presented indicate split high/low D can give higher brightness and brightness ceilings than high/low D and conventional bleaching when used in both D stages in an OD(EOP)D sequence on RDH and conventional kraft pulps. Comparable brightness to DeD bleaching has been found, and the split chlorine dioxide charge high/low pH bleaching process can bleach pulps of kappa greater than 10 successfully.

This new modification involves splitting the charge of $ClO_2$ between the two steps and omitting acid addition. A representative bleaching stage is outlined below:

(1) Pulp is mixed with an amount of sodium hydroxide that will give a pH of 3–4 at the end of the second step (although an end pH between 1.9–4.2 is acceptable and about 3.8 is preferred). A $ClO_2$ addition of 10–50% of the total charge is also mixed with the slurry and allowed to react for 5–15 minutes (although any time between 5–40 minutes is acceptable). The end pH of this reaction will vary depending on the amount of $ClO_2$ added but the pH should be at least 6 (although an end pH between 6.0–12.0 is acceptable). Reaction temperature is 70° centigrade.

(2) After the initial step, the remaining $ClO_2$ is added to the mixture. The reaction time and temperature is 2.5–2.9 hours (although any time greater than 2.0 hours is acceptable and a time between 2.5–3.9 hours is preferred) and 70° centigrade, respectively.

Figure 16:
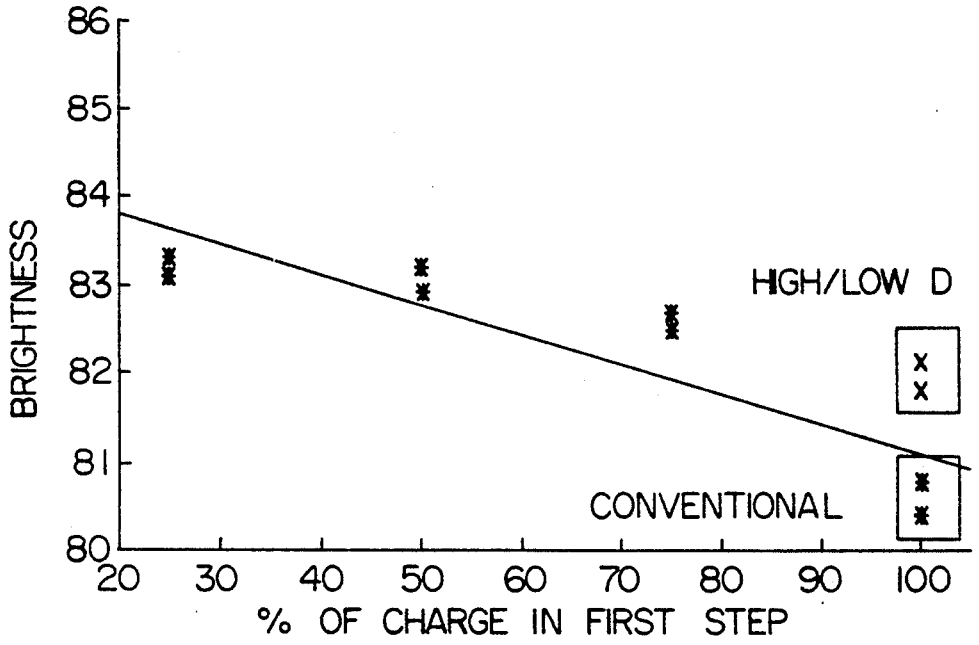
FIG. 16 is a graph of brightness response to split chlorine dioxide addition two-step high/low pH bleaching.
Figure 17:
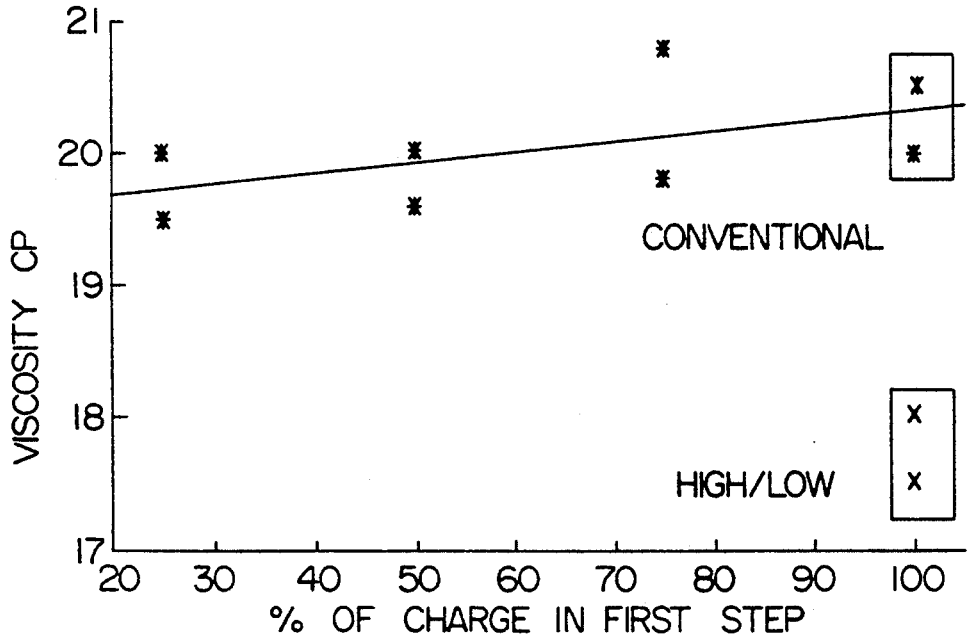
FIG. 17 is a graph of viscosity response to split chlorine dioxide addition two-step high/low pH bleaching.
Figure 18:
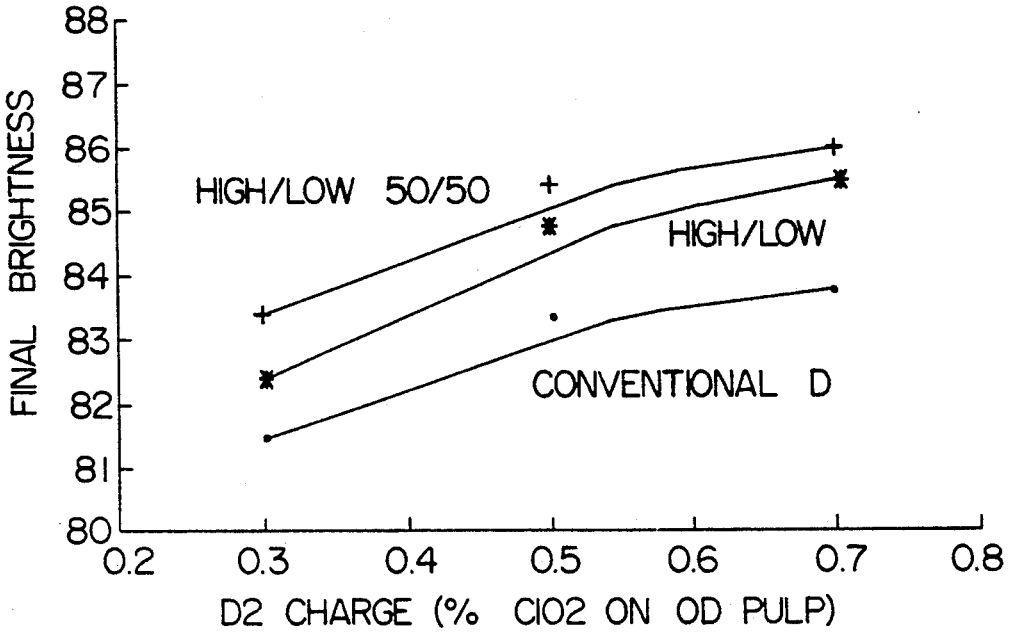
FIG. 18 is a graph of OD(EOP)AD bleaching sequence comparing conventional D stage bleaching, two step high/low pH bleaching, and split chlorine dioxide addition two-step high/low pH bleaching wherein $D_1$ charge is 0.6% $ClO_2$.
Figure 19:
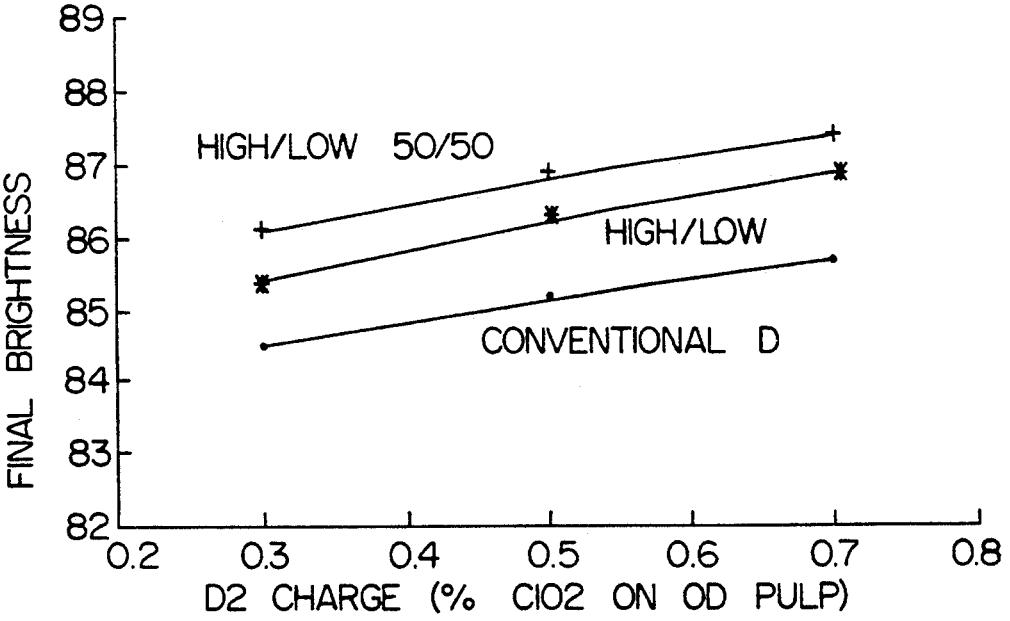
FIG. 19 is a graph of OD(EOP)AD bleaching sequence comparing conventional D stage bleaching, two step high/low pH bleaching, and split chlorine dioxide addition two-step high/low pH bleaching wherein $D_1$ charge is 0.83% $ClO_2$.

Brightness and viscosity response to splitting the $ClO_2$ charge into two steps at constant caustic charge is shown in FIGS. 16 and 17. Higher brightness and comparable viscosity are found when up to 50% of the $ClO_2$ charge is added in the first step. At higher amounts, the first step end pH falls below 6 and lower brightness is found. High/low D results are included in FIGS. 16 and 17 to demonstrate that lower brightness is found compared to the split addition high/low. First step end pH values vary between 11.5 to 5.8 depending on the amount of $ClO_2$ charged initially, and end pH values were between 3 and 3.4.

TABLE 4

Figure 20:
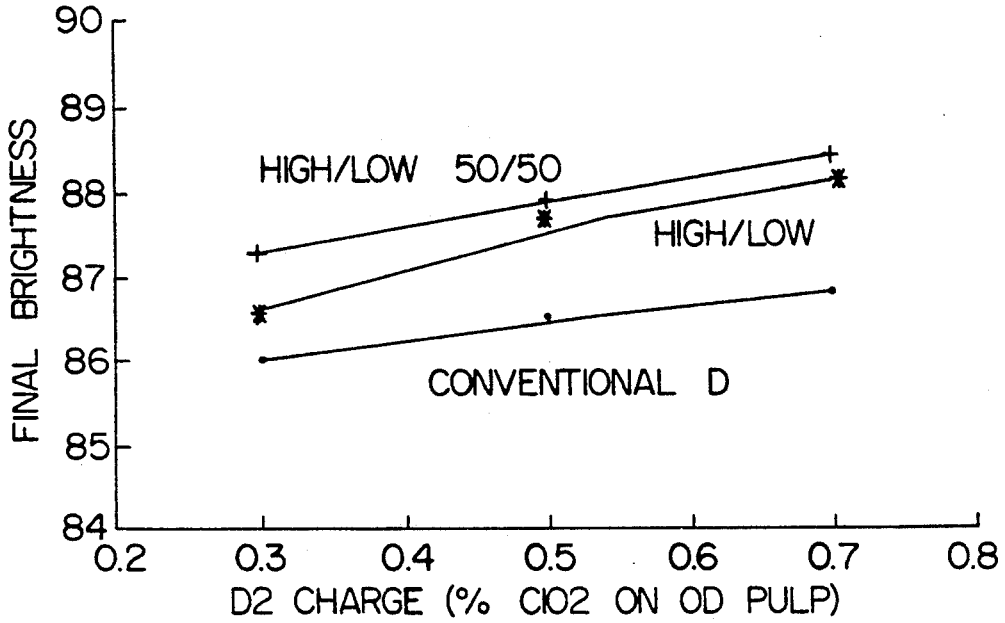
FIG. 20 is a graph of OD(EOP)AD bleaching sequence comparing conventional D stage bleaching, two step high/low pH bleaching, and split chlorine dioxide addition two-step high/low pH bleaching wherein $D_1$ charge is 1.1% $ClO_2$.
Figure 21:
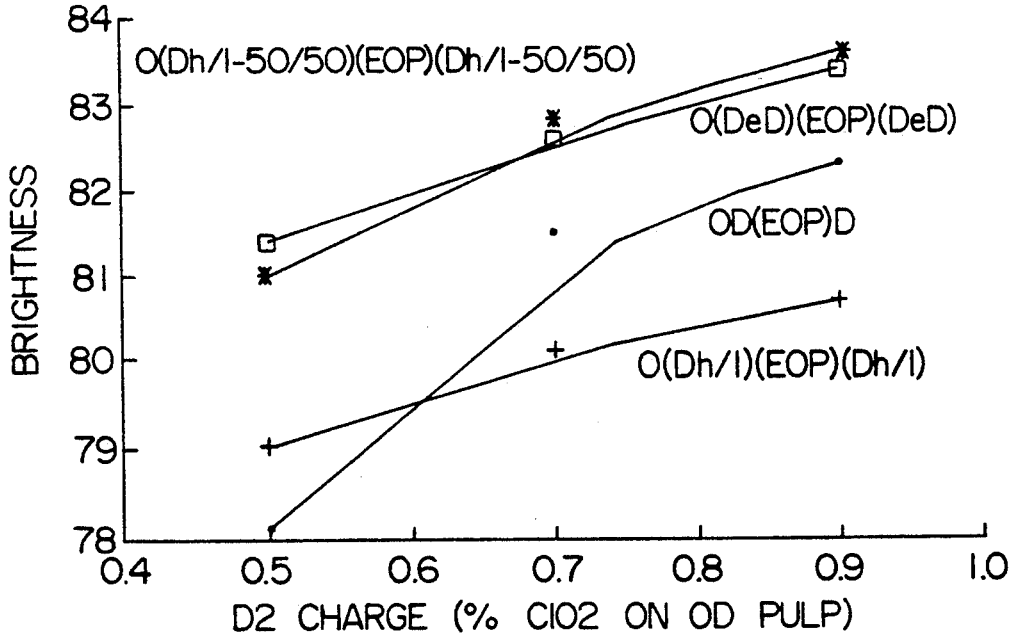
FIG. 21 is a graph of OD(EOP)D bleaching sequence of Mill Prepared Southern Pine.

D1 AND EOP BRIGHTNESS AND KAPPA NUMBERS FOR HIGH/LOW D, HIGH/LOW 50/50, AND CONVENTIONAL D IN AN OD(EOP)AD SEQUENCE (FINAL BRIGHTNESS IS GIVEN IN FIGS. 20–22)

| | Conventional | High/Low | High/Low 50/50 |
|---|---|---|---|
| | D1 Charge = 0.6% $ClO_2$ | | |
| D1 Brightness | 47.3 | 55.5 | 51.3 |
| D1 Kappa | 3.7 | 3.6 | 3.6 |
| EOP Brightness | 64.1 | 67.2 | 64.5 |
| EOP Kappa | 2.0 | 2.3 | 2.2 |
| | D1 Charge = 0.83% $ClO_2$ | | |
| D1 Brightness | 54.2 | 62.6 | 58.6 |
| D1 Kappa | 2.8 | 2.7 | 2.6 |
| EOP Brightness | 69.1 | 70.6 | 70.6 |
| EOP Kappa | 1.4 | 1.7 | 1.6 |
| | D1 Charge = 1.1% $ClO_2$ | | |
| D1 Brightness | 61.5 | 69.7 | 65.8 |
| D1 Kappa | 2.3 | 2.2 | 2.2 |
| EOP Brightness | 74.0 | 76.4 | 75.0 |
| EOP Kappa | 1.3 | 1.5 | 1.3 |

On bleaching RDH kraft pulp by the OD(EOP)AD sequence, it is evident that both high/low and split addition high/low (50% $ClO_2$ in first step, 50% in second) gives higher brightness throughout the sequence than conventional bleaching (see Table 4 above and FIGS. 16–20). The kappa after oxygen bleaching was 8.1, brightness and kappa results for the $D_1$ and EOP stages are listed in Table 4. As found before, better delignification for high/low is found during the $D_1$ stage but after oxidative extraction the kappa number is higher. Conventional bleaching delignifies the least in the $D_1$ stage but after extraction has the lowest kappa. Apparently the split chlorine dioxide addition high/low pH bleaching process does not brighten as well as high/low in the $D_1$ stage but it does delignify somewhat better after the EOP stage. This is believed to be the reason split high/low stages give the highest final brightness over the range of charges applied (see, for example, FIGS. 18–20). The reason for the good performance of high/low D stages over conventional is believed to be due to the low incoming kappa (<10) compared to a kappa of 17 for Table 4. Acid wash stages were used before the $D_2$ stage for iron removal, however, this stage was not necessary. Hydrogen peroxide charge in the EOP stage was 0.1%. A higher brightness ceiling was achieved using either high/low method in both D stages although the split high/low could reach 88% ISO with a total of 1.8% total $ClO_2$ for the sequence (see FIG. 20). A savings of 5-8 and 2-6 lb of $ClO_2$/ton of pulp is found using split high/low and high/low, respectively.

There are many different ways to run a D stage. Table 6 lists the brightness found at various $ClO_2$ charges in the D stage of a (CD)(EO)D sequence. The brownstock kappa was 29.6, kappa and brightness after the EO stage was 4.8 and 36.8% ISO, respectively. All split addition stages were run with 50% $ClO_2$ in the first step and 50% added in the second step.

TABLE 5

BRIGHTNESS COMPARISONS OF OTHER METHODS OF HIGH EFFICIENCY $ClO_2$ BLEACHING IN A (CD)(EO)D ON SEQUENCE SOUTHERN PINE PULP (BRIGHTNESS IN ISO)

| METHOD | 0.5% CHARGE | 0.8% CHARGE |
|---|---|---|
| HIGH/LOW D | 72.8 | 80.3 |
| SPLIT HIGH/LOW 50/50 | 72.4 | 80.2 |
| SPLIT 50/50 NO pH CONTROL | 69.2 | 77.1 |
| CONVENTIONAL D | 64.6 | 77.0 |

As indicated by Table 5, high/low split addition and high/low bleaching gave comparable brightness while split addition with no pH control (first and second step pH's both acidic) was lower. Evidently a high pH step is needed somewhere in the stage to achieve high efficiency.

TABLE 6

D1 AND EOP BRIGHTNESS FOR HIGH/LOW D, HIGH/LOW 50/50, AND CONVENTIONAL D IN AN OD(EOP)D SEQUENCE (FINAL BRIGHTNESS GIVEN IN FIG. 23) D1 CHARGE = 1.4% $ClO_2$ ON OD PULP

| | Conventional | High/Low 50/50 | High/Low |
|---|---|---|---|
| D1 Brightness | 46.2 | 47.0 | 52.9 |
| EOP Brightness | 59.2 | 61.5 | 64.6 |

In Table 6 and FIG. 21, the same brownstock pulp of kappa 29.6 from Table 5 was bleached by the OD-(EOP)D sequence. The kappa after oxygen delignification was 13.5. High/low again gives the highest brightness through the $D_1$ and EOP stages (see Table 6) but after the $D_2$ stage the final brightness is lower than any of the methods applied (see FIG. 21), again due to the incoming kappa being greater than 10. Split high/low stage gives comparable brightness throughout the whole sequence and the highest final brightness which suggests that the mechanisms for high efficiency are similar. A savings of up to 5 lb $ClO_2$/ton pulp is realized using split high/low compared to conventional D.

Process Parameters and Analytical Methods Used in Split Charge Two-Step High/Low Experiments

TABLE 7

CONDITIONS FOR BLEACHING EXPERIMENTS

| Stage | Charge | Time | Temp. | Consistency | End pH |
|---|---|---|---|---|---|
| O | 1-2% NaOH 100 psi $O_2$ 0.5% $MgSO_4$ | 1 hr | 110 C. | 20% | >11 |
| D | Varied | 3 hrs | 70 C. | 10% | 1.6-4 |
| H/L D | Varied | 5-15 min. | 70 C. | 10.5-13% | 5.8-11 |
| | | 2.5-2.9 hr | 70 C. | 10% | 1.6-4.4 |
| SPLIT H/L D | Varied | 5-15 min. | 70 C. | 10.5-13% | 6-12 |

TABLE 7-continued

CONDITIONS FOR BLEACHING EXPERIMENTS

| Stage | Charge | Time | Temp. | Consistency | End pH |
|---|---|---|---|---|---|
| | | 2.5-2.9 hr | 70 C. | 10% | 2-4 |
| EO NaOH | 0.45 × $Cl_2$ | 1 hr | 75 C. | 15% | >11 |
| EOP NaOH $H_2O_2$ | 0.5 × $Cl_2$ 0.1-0.4% | 1 hr | 75 C. | 15% | >11 |
| HOT EO NaOH | 0.45 × $Cl_2$ | 35 min | 100 C. | 15% | >11 |
| A | ACID WASH | | 25 C. | 3% | 2 |
| $H_2SO_3$ | 30% | 30 min | 60 C. | 3% | <2 |

To insure maximum mixing the CD stage for Table 5 was carried out in a plastic Nalgene bottle which rolled on a Ball-mill type apparatus for the full reaction time. O, EO, "hot" EO, and EOP stages were performed in 4 liter stainless steel bombs which were constantly rotated during the reaction time. All other bleaching stages were carried out in sealed high density polyester bags which were kneaded at various times throughout the bleach to insure proper mixing.

Stage conditions are listed in Table 7. All charges are on OD brownstock pulp. Large batches of prebleached (for example, O or (CD)E) pulp were made, then broken up into individual runs for comparison. All water used in bleaching and washing was distilled, and carry-over was not simulated.

$ClO_2$ solutions were generated on site by acidifying a sodium chlorite solution and absorbing the $ClO_2$ gas into cold distilled water. Chlorine content in the $ClO_2$ solutions was zero. Chlorine solutions were produced by bubbling chlorine gas into cold distilled water.

Analytical methods used in the tests are listed below:

| | |
|---|---|
| BRIGHTNESS | Elrepho 2000 ISO |
| VISCOSITY | Tappi T230 os-76 |
| KAPPA NUMBER | Tappi T236 hm-85 |

It will be understood that various details of the invention may be changed without departing from the scope of the invention. Furthermore, the foregoing description is for the purpose of illustration only, and not for the purpose of limitation—the invention being defined by the claims.

What is claimed is:

1. A two-step bleaching process for bleaching wood pulp in the $D_1$ or $D_2$ bleaching step in an aqueous suspension using chlorine dioxide and providing high brightness and a high brightness ceiling, comprising the steps of:

subjecting said aqueous wood pulp suspension to a first bleaching step during said $D_1$ or $D_2$ bleaching stage by mixing it with alkali and 10% to 50% of the total chlorine dioxide charge for about 5-40 minutes so that the pH at the end of said first bleaching step is between about 6.0-12.0; and adding the remaining portion of the total chlorine dioxide charge and subjecting said mixture to a second bleaching step during the $D_1$ or $D_2$ bleaching stage for about 2 or more hours so that the pH at the end of said second step is between about 1.9-4.2.

2. A bleaching process according to claim 1 wherein said alkali comprises sodium hydroxide.

3. A bleaching process according to claim 1 wherein the end pH of the mixture during said first bleaching step is between about 6.0–7.5.

4. A bleaching process according to claim 1 wherein the temperature during said first bleaching step is between about 50°–85° centigrade.

5. A bleaching process according to claim 4 wherein the temperature during said first bleaching step is about 70° centigrade.

6. A bleaching process according to claim 1 wherein the end pH of the mixture during said second bleaching step is about 3.8.

7. A bleaching process according to claim 1 wherein the temperature during said second bleaching step is between about 55°–85° centigrade.

8. A bleaching process according to claim 7 wherein the temperature during said second bleaching step is about 70° centigrade.

9. A bleaching process according to claim 1 wherein the final consistency of the mixture after the second bleaching step is between about 3–12%.

10. A bleaching process according to claim 9 wherein the final consistency of the mixture after the second bleaching step is about 10%.

11. A two-step bleaching process for bleaching wood pulp in the $D_1$ or $D_2$ bleaching stage in an aqueous suspension using chlorine dioxide providing high brightness and a high brightness ceiling, comprising the steps of:

subjecting said aqueous wood pulp suspension to a first bleaching step during said $D_1$ or $D_2$ bleaching stage by mixing it with alkali and 10% to 50% of the total chlorine dioxide charge for about 5–40 minutes at a temperature of about 70° C. so that the pH at the end of said first bleaching step is between about 6.0–7.5; and adding the remaining portion of the total chlorine dioxide charge and subjecting said mixture to a second bleaching step during said $D_1$ or $D_2$ bleaching stage at a temperature of about 70° C. for about 2.5–2.9 hours so that the pH at the end of the second step is about 3.8.

12. A bleaching process according to claim 11 wherein said alkali comprises sodium hydroxide.

13. A bleaching process according to claim 11 wherein the final consistency of the mixture after the second bleaching step is about 10%.

* * * * *